US009547278B2

(12) United States Patent
Graf et al.

(10) Patent No.: US 9,547,278 B2
(45) Date of Patent: Jan. 17, 2017

(54) BALANCE WITH INERTIA ADJUSTMENT

(71) Applicant: Nivarox-FAR S.A., Le Locle (CH)

(72) Inventors: Emmanuel Graf, Le Locle (CH); Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/828,709

(22) Filed: Aug. 18, 2015

(65) Prior Publication Data

US 2016/0062314 A1 Mar. 3, 2016

(30) Foreign Application Priority Data

Aug. 26, 2014 (EP) ..... 14182343

(51) Int. Cl.

| | |
|---|---|
| ***G04B 17/20*** | (2006.01) |
| ***G04B 18/00*** | (2006.01) |
| ***G04B 17/06*** | (2006.01) |

(52) U.S. Cl.

CPC ..... *G04B 17/20* (2013.01); *G04B 17/063* (2013.01); *G04B 18/006* (2013.01)

(58) Field of Classification Search

CPC ..... G04B 17/00; G04B 17/22; G04B 18/00; G04B 18/006; G04B 17/24; G04B 17/20; G04B 17/063

See application file for complete search history.

(56) References Cited

U.S. PATENT DOCUMENTS 455,787 A * 7/1891 Bilgram ..... G04B 17/222 368/171
510,202 A 12/1893 Smith
631,103 A * 8/1899 Borel ..... G04B 17/222 368/171
1,350,035 A * 8/1920 Povelsen ..... G04B 17/222 368/170
2,770,942 A * 11/1956 Favret ..... G04B 18/006 368/170
2,880,570 A * 4/1959 Favret ..... G04B 18/006 368/170
3,382,667 A * 5/1968 Van Horn ..... G04B 18/006 368/171

(Continued)

FOREIGN PATENT DOCUMENTS

| | | |
|---|---|---|
| CH | 698 024 B1 | 4/2009 |
| CH | 703 463 A2 | 1/2012 |
| EP | 2 410 386 A1 | 1/2012 |

OTHER PUBLICATIONS

European Search Report issued May 22, 2015 in European Application 14182343, filed on Aug. 26, 2014.

*Primary Examiner* — Sean Kayes
(74) *Attorney, Agent, or Firm* — Oblon, McClelland, Maier & Neustadt, L.L.P.

(57) ABSTRACT

Balance with inertia adjustment for timepieces, including a hub defining the pivot axis of the balance, a rim, a web extending between a lower plane and an upper plane on either side of a median plane, the web including at least one arm connecting the rim to the hub, the arm including a housing configured to receive and hold in place at least one inertia block. According to the invention, the inertia block has a front face and a rear face and is integrated in the balance arm, so that the front face and rear face are substantially in the upper plane and the lower plane.

20 Claims, 3 Drawing Sheets

(56) References Cited

U.S. PATENT DOCUMENTS

| | | | | |
|---|---|---|---|---|
| 3,455,104 | A * | 7/1969 | McCullough | G04B 18/006 368/170 |
| 8,414,184 | B2 * | 4/2013 | Mallet | G04B 18/006 368/127 |
| D700,535 | S * | 3/2014 | Graf | D10/128 |
| 2013/0188461 | A1 | 7/2013 | Mallet et al. | |

* cited by examiner

BALANCE WITH INERTIA ADJUSTMENT

This application claims priority form European Patent Application No. 14182343.5 filed on Aug. 26, 2014, the entire disclosure of which is hereby incorporated herein by reference.

FIELD OF THE INVENTION

The invention relates to a balance with inertia adjustment having means for adjusting inertia.

The invention also concerns a timepiece movement including such a system and a timepiece equipped with such a movement.

BACKGROUND OF THE INVENTION

There is known from CH Patent No 705238 a balance with clamped inertia blocks for adjusting the inertia and/or poise of the balance. The balance has two arms each including a housing for receiving and clamping in position an arbor of an inertia block, the head of the inertia block resting against the front face of the balance.

The balance described above has several drawbacks. It will be mentioned first of all that access to the inertia blocks may be difficult depending on the architecture of the movement and may make the inertia adjustment complicated, which may result in increased adjustment costs. Moreover, such a balance takes up a relatively large amount of place, since the head of the inertia blocks rests in the balance recess, which may result in an increase in the thickness of the movement.

There is also known from EP Patent No 1351103 a balance with inertia adjustment for a timepiece movement wherein the rim has recessed portions for receiving inertia blocks so that there are no protruding parts. Although this facilitates the adjustment of the balance, machining is required to form the recessed portions, which is relatively difficult, time-consuming and expensive.

SUMMARY OF THE INVENTION

It is an object of the invention to overcome the various drawbacks of these known techniques.

More specifically, it is an object of the invention to provide a balance with inertia adjustment making it possible to obtain a compact timepiece movement.

It is also an object of the invention, at least in a particular embodiment, to provide a balance with inertia adjustment that is simple to implement and inexpensive to produce.

These objects, in addition to others which will appear more clearly below, are achieved according to the invention by means of a balance with inertia adjustment, for timepieces, including a hub defining the pivot axis of said balance, a rim, a web extending between a lower plane and an upper plane on either side of a median plane, said web including at least one arm connecting said rim to said hub, said at least one arm including a housing configured to receive and hold in place at least one inertia block.

According to the invention, said at least one inertia block has a front face and a rear face and is integrated in said arm of said balance, so that said front and back faces are substantially in said upper plane and said lower plane.

In accordance with other advantageous variants of the invention:

- the front face and the rear face of the at least one inertia block are set back by 0 μm to 1 mm with respect to the upper plane and to the lower plane;
- the front face and the rear face of the at least one inertia block protrude by 0 μm to 0.6 mm with respect to the upper plane and to the lower plane;
- the at least one inertia block is in the median plane of the web;
- the housing and the at least one inertia block are of complementary shape;
- the at least one inertia block is clamped with a predetermined retaining torque inside the housing;
- the at least one inertia block is cylindrical;
- the arm has an elastic portion extending in the median plane, the elastic portion being capable of deforming during assembly of the at least one inertia block;
- the housing includes stops in the upper plane and the lower plane to hold in place the at least one inertia block;
- the at least one inertia block includes upper and lower wings intended to rest on either side of the arm respectively in the lower and upper plane to hold the at least one inertia block axially in place;
- the at least one inertia block is pressed into the housing of the balance arm;
- the arm and the rim have the same thickness.

The invention also concerns a timepiece movement including a balance according to the invention.

The invention also concerns a timepiece including a timepiece movement according to the invention.

Thus, the subject of the present invention, by means of the different functional and structural aspects described above, provides a relatively compact balance with inertia adjustment.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

Figure 1:
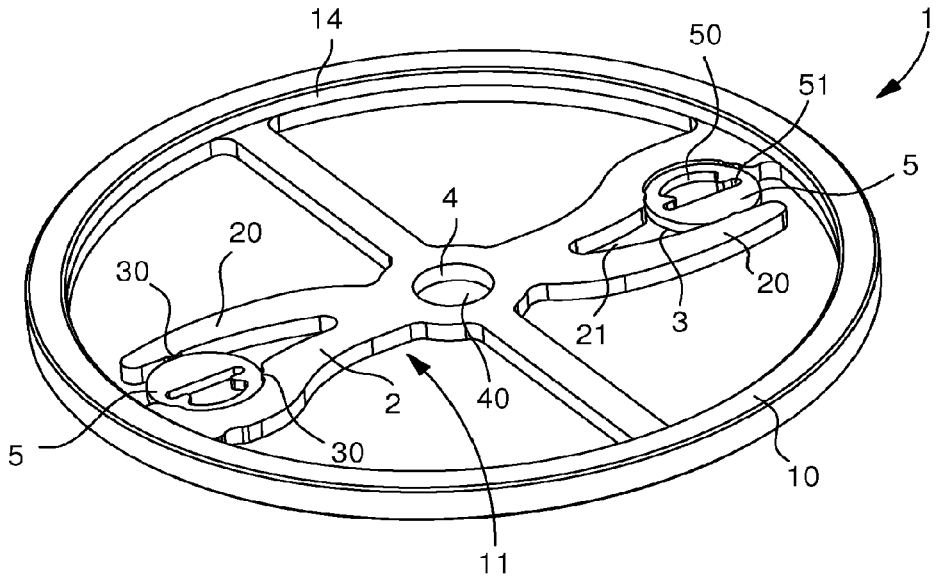
FIG. 1 is a perspective view of a balance conforming to the invention according to a first embodiment.

A timepiece movement according to an example embodiment will now be described below with reference jointly to FIGS. 1, 2, 3 and 4.

The invention therefore concerns a balance 1 with inertia adjustment, for timepieces, including a hub 4 defining the pivot axis A of balance 1, a rim 10, a web 11 extending between a lower plane Pi and an upper plane Ps on either side of a median plane Pm, web 11 including at least one arm 2 connecting rim 10 to hub 4, the at least one arm 2 including a housing 3 configured to receive and hold in place at least one inertia block 5.

According to the invention, the balance has a front face 12 having a recess 14 and a rear face 13 which may also be recessed.

According to a particular embodiment, the height of rim 10 may be identical to web 11, in that case balance 1 has no recess which makes it possible to obtain the most compact possible balance.

As illustrated, balance 1 includes four arms, forming a hub 4 at the intersection thereof, hub 4 being provided with an orifice 40 intended to receive a balance staff 41, web 11 therefore being formed by the four arms and the hub 4.

Rim 10 is of circular shape and, like arms 2, has no protruding portions, so that balance 1 is as compact as possible.

As can be observed in the Figures, inertia block 5 is of cylindrical shape and includes a front face 52 and a rear face 53 and may, according to one embodiment of the invention, have upper and lower wings 54 and 55.

Advantageously, each inertia block 5 is clamped inside a housing 3 in an operating position where a median plane of the inertia block coincides with the median plane Pm of web 11.

Balance 1 includes rigid portions formed by hub 4, rim 10 and arms 2 connecting rim 10 to hub 4. Housing 3 is delimited, on the one hand by a rigid portion of balance 1, and on the other hand by an elastically deformable arm 20.

According to a particular embodiment of the invention, not illustrated in the Figures, rim 10 of the balance has the same thickness as arms 2 of balance 1 and thus merges with arms 2 of the balance, arms 2 and rim 10 thus forming a plane element.

According to the invention, housing 3 is delimited by a rigid portion of arm 2 and by an elastic portion 20 integral with a rigid portion of arm 2, elastic portion 20 being constantly returned towards the rigid portion of arm 2 delimiting housing 3.

Advantageously, in the extension of housing 3, arm 2 has a recessed part 21 intended to facilitate the deformation of elastic portion 20.

According to a preferred embodiment, housing 3 is substantially the same shape as inertia block 5. This embodiment is particularly advantageous since it limits the thickness of balance 1 once inertia blocks 5 are mounted on balance 1.

In this preferred embodiment, elastic portion 20 extends in the median plane Pm of the web; arm 2 with a recess 21 facilitates the deformation of elastic portion 20.

Balance 1 also includes adjustment inertia blocks 5 of cylindrical shape, inertia blocks 5 being provided with an opening 50 in the shape of a half-moon, or any other shape, and drive means 51 such as an adjustment notch or any other means known to those skilled in the art for adjusting the position of inertia block 5.

Figure 3:
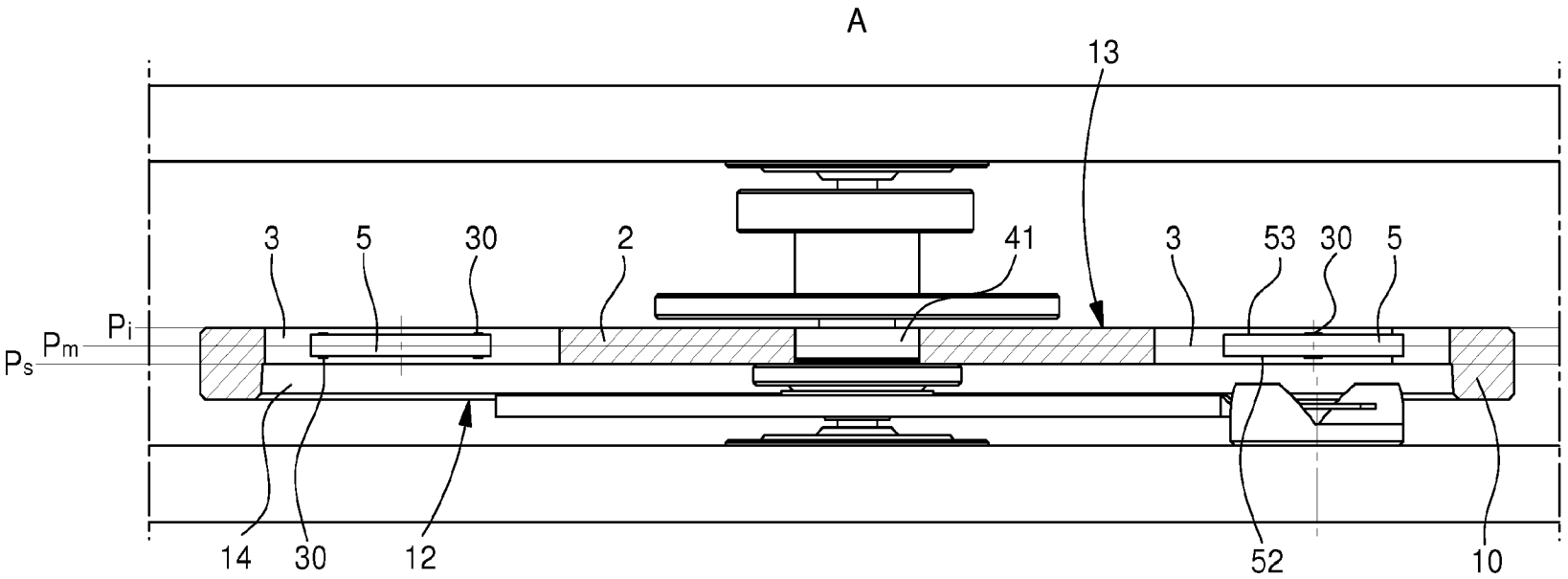
FIGS. 3 and 4 are respectively cross-sectional views of a balance according to the first and second embodiments illustrated in FIGS. 1 and 2.

According to a first embodiment, illustrated in FIGS. 1 and 3, housing 3 and elastic portion 20 of complementary shape to inertia block 5 include stops 30 in proximity to the upper and lower edges of housing 3, respectively in upper plane Ps and lower plane Pi, to hold inertia block 5 in place in median plane Pm in housing 3 while allowing it to rotate.

These housings 3 make it possible to obtain inertia blocks 5 completely embedded in arms 2 of balance 1. When inertia blocks 5 are placed in housings 3, the inertia blocks are clamped in housings 3 and are thus held in position by friction by means of the elasticity of elastic arm 20.

Figure 2:
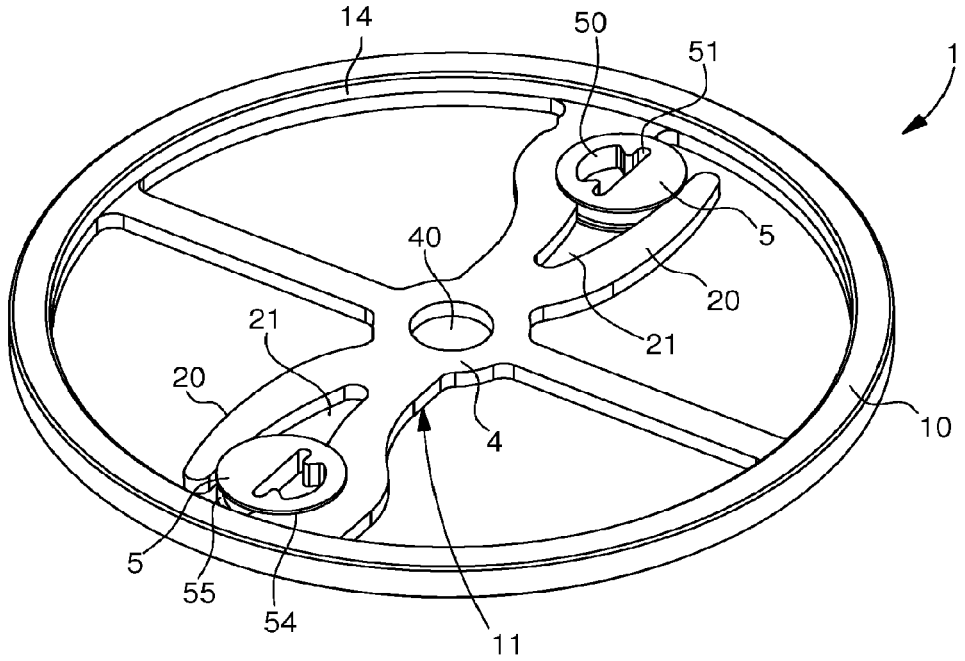
FIG. 2 is a perspective view of a balance conforming to the invention according to a second embodiment.
Figure 4:
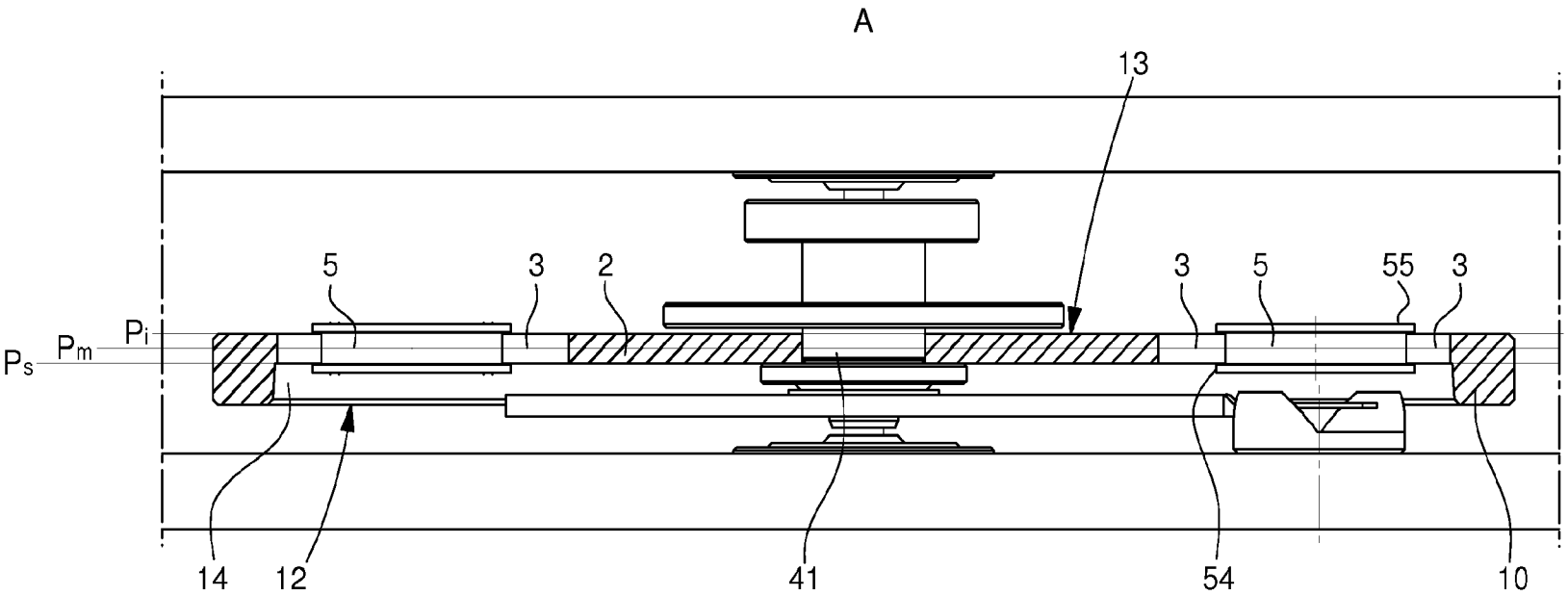

According to a second embodiment, visible in FIGS. 2 and 4, inertia block 5 includes upper and lower leaves intended to rest on either side of arm 2, and more precisely on either side of housing 3, respectively in lower plane Pi and upper plane Ps so as to hold inertia block 5 in housing 3 while allowing it to rotate in said housing 3.

Advantageously, inertia block 5 is integrated in arm 2 of balance 1 so that the front and back faces are substantially in upper plane Ps and lower plane Pi. "Substantially" means that front face 52 and rear face 53 are set back by 0 μm to 1 mm with respect to upper plane Ps and lower plane Pi in the first embodiment and that the upper and lower wings of inertia block 5 protrude by 0 μm to 0.6 mm with respect to upper plane Ps and lower plane Pi in the second embodiment. Such an arrangement makes it possible to obtain a balance with inertia adjustment having a reduced space requirement.

This balance 1 according to the invention makes it possible, in particular, to mount inertia blocks 5 on arms 2 of balance 1 regardless of the direction of assembly of the balance. Generally, those skilled in the art will choose the direction of assembly of inertia blocks 5 on balance 1 depending on the ease of access to inertia blocks 5 once balance 1 is mounted in a movement.

The invention also concerns a timepiece movement and a timepiece equipped with a balance according to the invention.

As a result of these different aspects of the invention, there is obtained a compact balance which reduces the thickness of the timepiece movement and is inexpensive to produce.

Of course, the present invention is not limited to the illustrated example and is capable of various variants and modifications that will appear to those skilled in the art.

LIST OF PARTS

1. Balance
10. Rim
11. Web
12. Front face of the balance
13. Rear face of the balance
14. Recess
2. Arms
20. Elastic portion
21. Recessed part
3. Housings
30. Stops
4. Hub
40. Orifice
41. Balance staff
5. Inertia block
50. Opening
51. Drive means
52. Front face of the inertia block
53. Rear face of the inertia block
54. Upper wing of the inertia block
55. Lower wing of the inertia block
A. Pivot axis
Pm. Median plane
Pi. Lower plane
Ps. Upper plane

What is claimed is:

1. A balance with inertia adjustment, for timepieces, comprising:

a hub defining a pivot axis of said balance, a rim, a web extending between a lower plane and an upper plane on either side of a median plane, said web including at least one arm connecting said rim to said hub, said at least one arm including a housing configured to receive and hold in place at least one inertia block, wherein said at least one inertia block has a front face and a rear face and is integrated in said arm of said balance, so that said front face and rear face are substantially in said upper plane and said lower plane, wherein said arm includes an elastic portion that is a separate piece from the at least one inertia block, and wherein the elastic portion clamps the at least one inertia block in the housing.

2. The balance according to claim 1, wherein said front face and said rear face of said at least one inertia block are set back by 0 μm to 1 mm with respect to said upper plane and to said lower plane.

3. The balance according to claim 1, wherein said front face and said rear face of said at least one inertia block project by 0 μm to 0.6 mm with respect to said upper plane and to the lower plane.

4. The balance according to claim 1, wherein said at least one inertia block is in said median plane of said web.

5. The balance according to claim 1, wherein said housing and said at least one inertia block are of complementary shape.

6. The balance according to claim 1, wherein said at least one inertia block is clamped with a predetermined retaining torque inside said housing.

7. The balance according to claim 1, wherein said at least one inertia block is cylindrical.

8. The balance according to claim 1, wherein said elastic portion extends in said median plane, and said elastic portion is deformable during an assembly of said at least one inertia block.

9. The balance according to claim 1, wherein said housing includes stops in the upper plane and lower plane to hold said at least one inertia block axially in place.

10. The balance according to claim 1, wherein said at least one inertia block includes upper and lower wings to rest on either side of said arm respectively in the lower plane and the upper plane to hold said at least one inertia block axially in place.

11. The balance according to claim 1, wherein said at least one inertia block is driven into said housing of said arm of said balance.

12. A timepiece including the movement according to claim 11.

13. The balance according to claim 1, wherein said arm and said rim have a same thickness.

14. A timepiece movement including the balance according to claim 1.

15. The balance according to claim 1, wherein the at least one inertia block is held in the housing by friction.

16. The balance according to claim 1, wherein the at least one inertia block is rotatable in the housing.

17. The balance according to claim 1, wherein the at least one inertia block is rotatable in the housing about an axis parallel to the pivot axis of said balance.

18. A balance with inertia adjustment, for timepieces, comprising:

a hub defining a pivot axis of said balance, a rim, a web extending between a lower plane and an upper plane on either side of a median plane, said web including at least one arm connecting said rim to said hub, said at least one arm including a housing configured to receive and hold in place at least one inertia block, wherein said at least one inertia block has a front face and a rear face and is integrated in said arm of said balance, so that said front face and rear face are substantially in said upper plane and said lower plane, wherein said arm includes an elastic portion that is a separate piece from the at least one inertia block, and wherein the at least one inertia block is rotatable in the housing about an axis parallel to the pivot axis of said balance.

19. The balance according to claim 18, wherein said front face and said rear face of said at least one inertia block are set back by 0 μm to 1 mm with respect to said upper plane and to said lower plane.

20. The balance according to claim 18, wherein the elastic portion clamps the at least one inertia block in the housing.

* * * * *